US011819104B2

(12) United States Patent
Cheng et al.

(10) Patent No.: US 11,819,104 B2
(45) **Date of Patent: *Nov. 21, 2023**

(54) LIGHT SOLIDIFYING DEVICE HAVING A MAGNETIC SLIDE COVER

(71) Applicant: Nail Alliance, LLC, Gladstone, MO (US)

(72) Inventors: Kuo-Chang Cheng, New Taipeo (TW); Danny Lee Haile, La Habra, CA (US)

(73) Assignee: Nail Alliance, LLC, Gladstone, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/734,736

(22) Filed: May 2, 2022

(65) Prior Publication Data

US 2022/0322808 A1 Oct. 13, 2022

Related U.S. Application Data

(60) Division of application No. 16/780,794, filed on Feb. 3, 2020, now Pat. No. 11,344,097, which is a continuation of application No. 14/260,854, filed on Apr. 24, 2014, now Pat. No. 10,548,382, which is a continuation of application No. 13/290,086, filed on Nov. 6, 2011, now Pat. No. 8,739,431.

(51) Int. Cl.
*A45D 29/00* (2006.01)

(52) U.S. Cl.
CPC ..... *A45D 29/00* (2013.01); *A45D 2200/205* (2013.01)

(58) Field of Classification Search
CPC ..... A45D 29/00; A45D 2200/205; F26B 3/28
See application file for complete search history.

(56) References Cited

U.S. PATENT DOCUMENTS

| | | | | |
|---|---|---|---|---|
| 381,464 | A | 4/1888 | Crane | |
| 3,287,824 | A | 11/1966 | Selditz | |
| 5,084,984 | A | 2/1992 | Duchoud et al. | |
| 6,950,316 | B2 | 9/2005 | Pan et al. | |
| 7,239,806 | B2 | 7/2007 | Chen | |
| 7,804,074 | B2 | 9/2010 | Bernecker | |
| 8,242,475 | B1 | 8/2012 | Cheng | |
| 8,739,431 | B2 | 6/2014 | Cheng | |
| 10,548,382 | B2 | 2/2020 | Cheng | |
| 11,344,097 | B2 * | 5/2022 | Cheng | A45D 29/00 |

(Continued)

FOREIGN PATENT DOCUMENTS

| | | | |
|---|---|---|---|
| CN | 201227850 | Y | 4/2009 |
| CN | 201375149 | Y | 1/2010 |

(Continued)

OTHER PUBLICATIONS

Khandpur, R.S., Input/Output Terminals: in: Printed Circuit Boards, 2005, New Delhi, Tata McGraw-Hill Publishing Company Limited, p. 117.

*Primary Examiner* — David J Laux
(74) *Attorney, Agent, or Firm* — Blank Rome LLP

(57) ABSTRACT

Nail gel curing devices emitting ultraviolet light, as well as methods of their making and use are disclosed. The devices are useful for curing, inter alia, acrylic compositions, more particularly, acrylic nail gel compositions, and typically employ ultraviolet and/or visible light emitting diodes ("LED") to cure such ultraviolet and/or visible light curable nail gel resins.

9 Claims, 4 Drawing Sheets

(56) References Cited

U.S. PATENT DOCUMENTS

| | | | |
|---|---|---|---|
| 2004/0065336 | A1 | 4/2004 | Fung |
| 2007/0107169 | A1 | 5/2007 | Kung |
| 2011/0277338 | A1 | 11/2011 | Li et al. |

FOREIGN PATENT DOCUMENTS

| | | | |
|---|---|---|---|
| CN | 201779632 | U | 3/2011 |
| CN | 201879014 | U | 6/2011 |
| CN | 201919973 | U | 8/2011 |
| KR | 888351 | B1 | 3/2009 |

* cited by examiner

LIGHT SOLIDIFYING DEVICE HAVING A MAGNETIC SLIDE COVER

CROSS REFERENCE TO RELATED APPLICATIONS

This application is a divisional of U.S. patent application Ser. No. 16/780,794, filed on Feb. 3, 2020, which is a continuation of U.S. patent application Ser. No. 14/260,854, filed on Apr. 24, 2014, now U.S. Pat. No. 10,548,382, which is a continuation of U.S. patent application Ser. No. 13/290,086, filed on Nov. 6, 2011, now U.S. Pat. No. 8,739,431, all of which are hereby incorporated herein by reference in their entirety.

FIELD OF THE INVENTION

The present invention relates generally to a light solidifying device in nail art, and in particular to a light solidifying device having a magnetic slide cover.

BACKGROUND OF THE INVENTION

In nail art, people coat a layer of pigment or liquid gel to decorate the nails with different colors, or attach decoration pieces on the nails to show different styles of the nail art. In order to quickly dry the pigment or the liquid gel, the hair dryer is often used to directly blow the pigment or the liquid gel. However, this causes the pigment or the liquid gel to be rippled, and the hot air makes the users feel uncomfortable.

The use of UV light to treat the UV liquid gel coated on the nails of toes and fingers is developed and called UV Curing or UV Coating. The difference between the conventional drying method and the UV light solidifying method is that the former vaporizes the volatile solvent in the liquid gel to solidify the liquid gel, while the latter utilizes Ultra-Violet light to irradiate and solidify the liquid gel coated on the nails. The UV light solidifying method has advantages of no solvent vaporization during the solidification cross-linking process, a shorter required solidification time, no ripple or deformed gel formed on the nails, and good solidification performance. Furthermore, there are other types of light solidifying devices for solidifying the liquid gel on the nails.

The conventional UV solidifying device for nail art generally has a rectangular base, a UV light source of which is arranged in such a way that the UV light irradiates the nails in parallel with or perpendicular to the fingers. However, the nails each have different curves and angles relative to a longitudinal direction of each finger, so that the straight going UV light cannot evenly irradiate the nails, thereby resulting in an uneven and unstable solidification in the nail art.

Furthermore, the UV light of the conventional UV solidifying devices escaping from an opening of the devices may irradiate users' eyes and skin that will make the users feel uncomfortable or even be harmful to the eyes and skin.

SUMMARY OF THE INVENTION

A primary objective of the present invention is to provide a light solidifying device designed in such a way that the irradiation direction of the light rays substantially faces to users' finger nails. Furthermore, the light solidifying device comprises a movable shielding structure for shielding the light rays.

In order to achieve the above-mentioned objective, a light solidifying device according to the present invention comprises a body, a magnetic slide cover unit connected to the body, a control unit connected to the body, and a light solidifying unit disposed in the body. The body includes an outer case having a first opening. A slide slot is defined around the first opening and points toward the first opening. An inner case is a polygonal case and disposed in the outer case. The inner case has a second opening and an inclined sidewall. The outer case and the inner case are connected to a base.

The magnetic slide cover unit has a slide cover having a third opening and the slide cover has a boss which is engaged with the slide slot of the outer case. The boss is connected to a fixing member and the slide cover is slidably movable toward the first opening of the outer case by moving the boss along the slide slot. The slide cover has a first magnetic member and the outer case has a second magnetic member which is located corresponding to the first magnetic member. The third opening of the slide cover is located corresponding to the first opening of the outer case and the second opening of the inner case.

The control unit is connected to the body and has a receptacle, a circuit board and a control member connected to the circuit board. The control member of the control unit is exposed out from the outer case.

The light solidifying unit is disposed in the body and has a light emitting diode module. The light emitting diode module has a heat dissipating member and a light emitting diode (LED) located in opposite to the heat dissipating member and connected to the wall of the inner case, so that the LED can irradiate an interior of the inner case. The light solidifying unit, the receptacle of the control unit and the circuit board are electrically connected together, so that the user can control the power "on" or "off", or adjust the required solidification time.

When the user proceeds with the solidification to the liquid gel on a user' finger nails, the user's hand is inserted into the device via the first and second openings and put on the base. The slide cover is moved downward and masked the first and second openings. The third opening of the slide cover is kept opened for the insertion of the user's hand. Therefore, the gap between the hand and the third opening is small enough to stop the light rays from escaping out from the device to stimulate the user's eyes and skin. The position of the slide cover can be adjusted according to practical needs. Then, the user can start to operate the control member of the control unit to activate the light emitting diode to proceed with the solidification and sterilization process. Because the inner case is a polygonal case and the inclined sidewall of the inner case is arranged to face to the finger nails, especially to the thumb nail, in a direction perpendicular to the inclined sidewall, each of the finger nails can be fully irradiated by the UV light rays.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENTS

Figure 1:
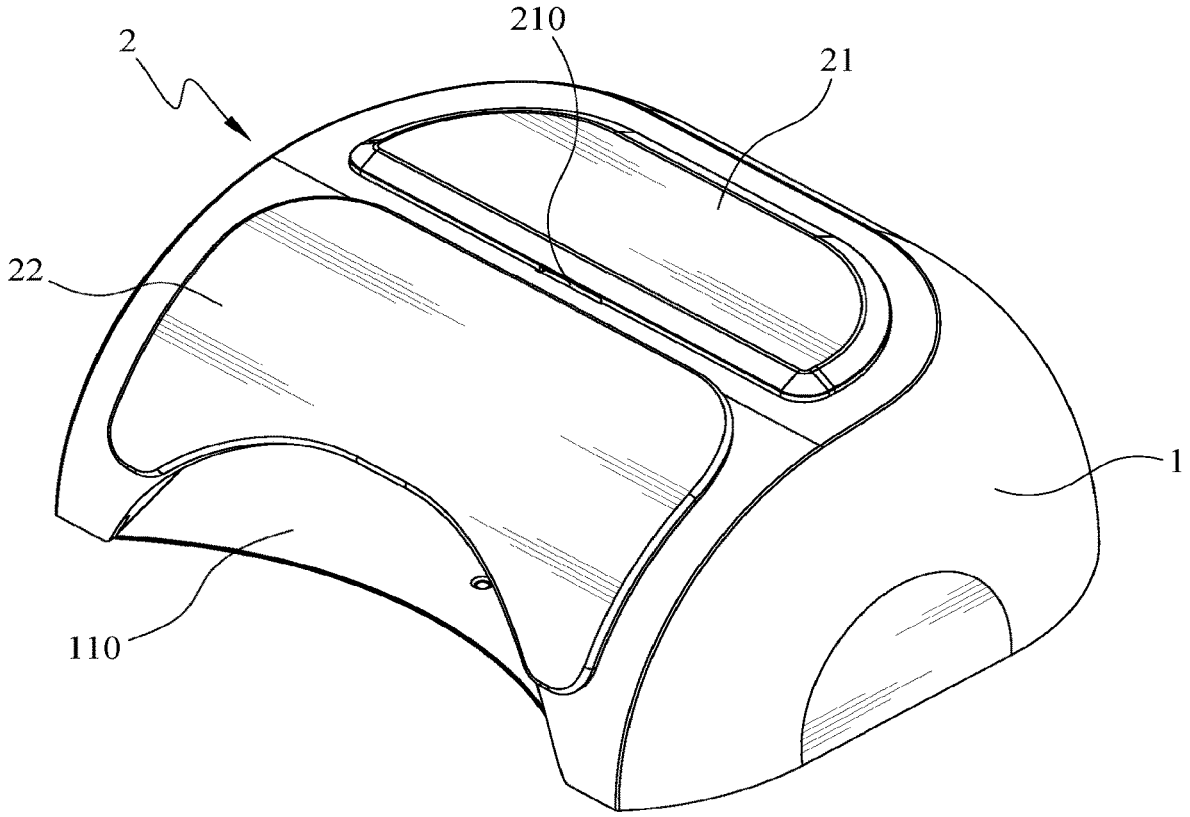
FIG. 1 is a perspective view of a light solidifying device in accordance with the present invention.
Figure 2:
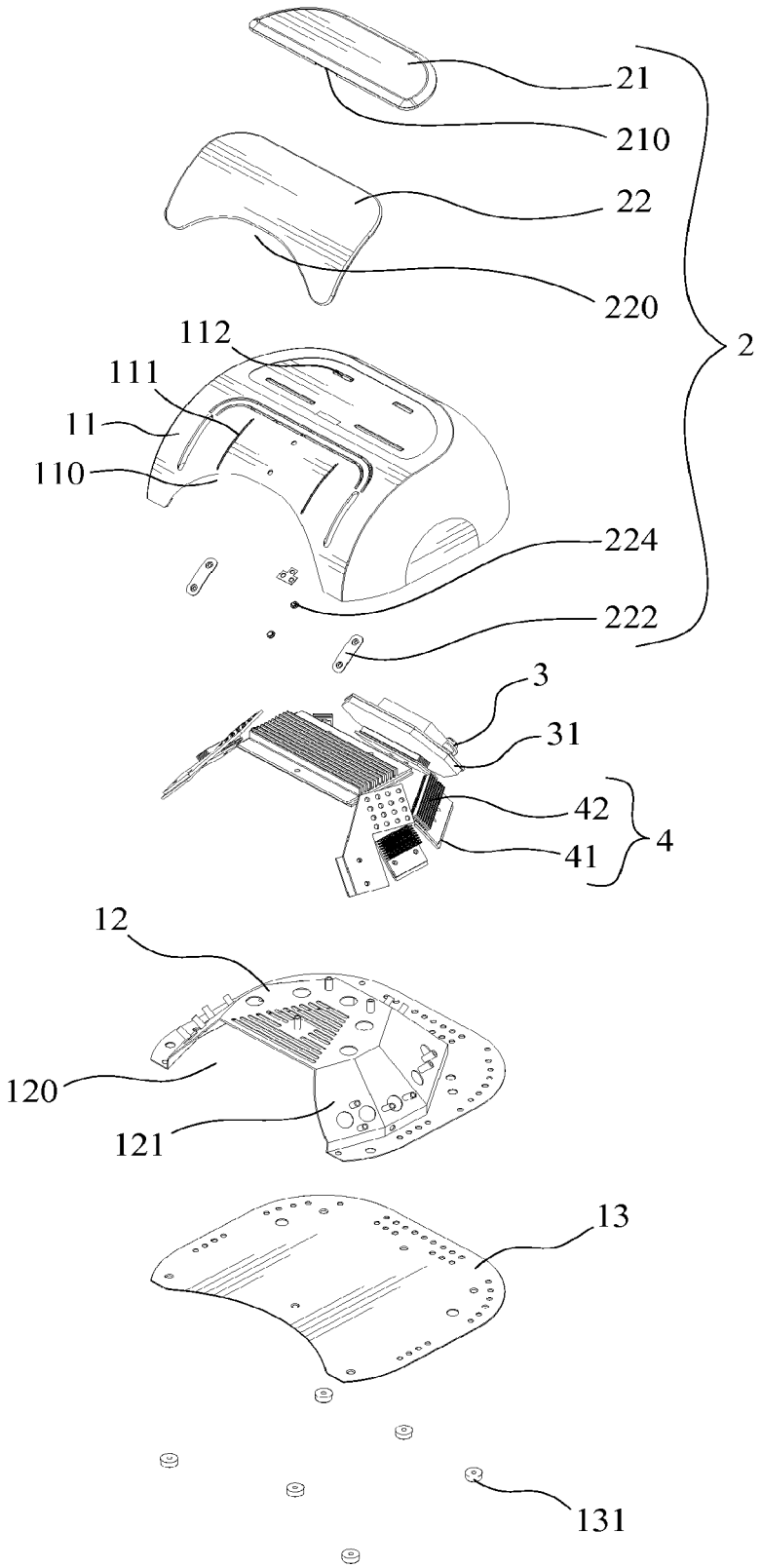
FIG. 2 is a perspective exploded view of the light solidifying device of the present invention.
Figure 3:
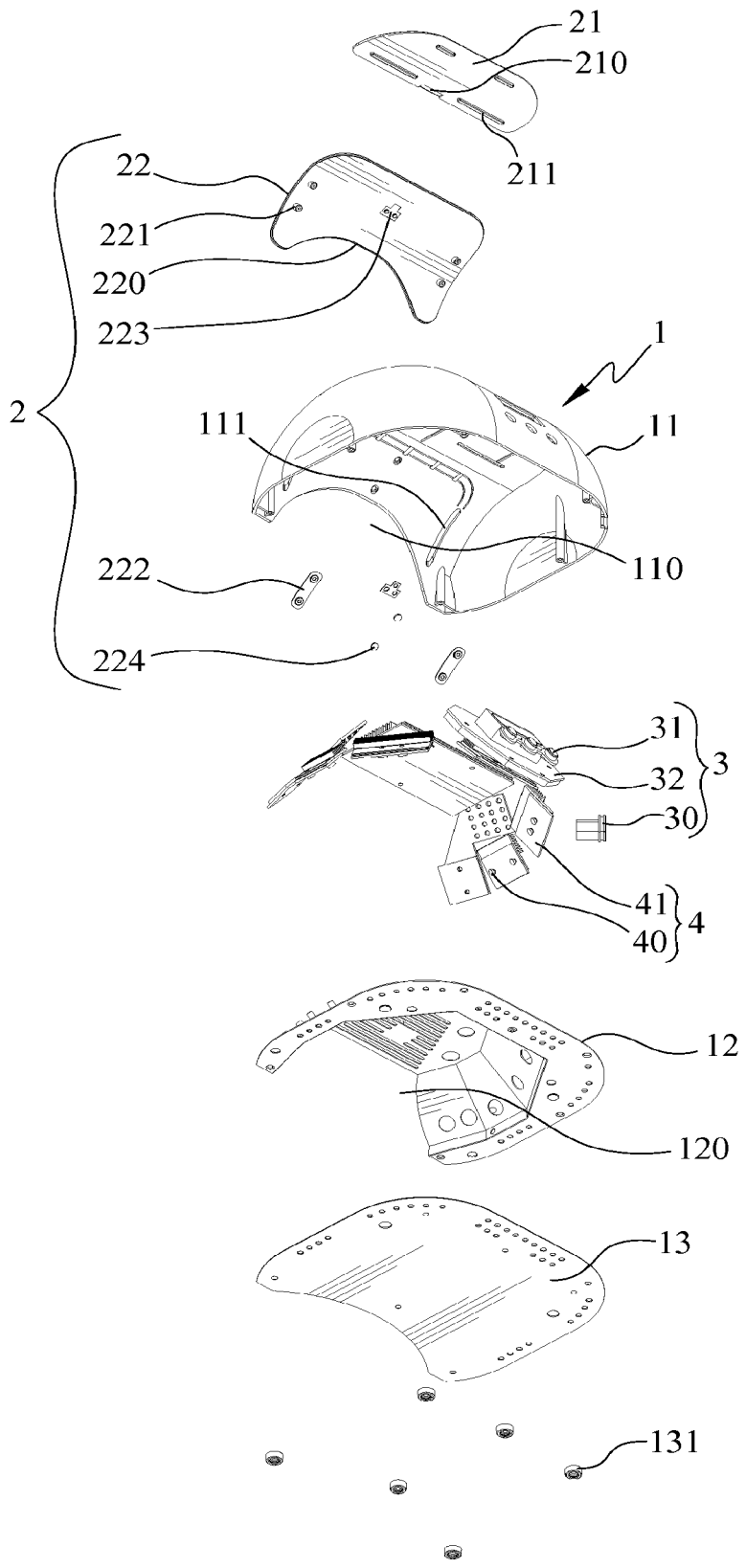
FIG. 3 is a perspective exploded view of the light solidifying device of the present invention, which is viewed from another direction.

With reference to the drawings and in particular to FIGS. 1 to 3, a light solidifying device in accordance with the present invention comprises a body 1, a magnetic slide cover unit 2, a control unit 3, and a light solidifying unit 4. The body 1 has an outer case 11 having a first opening 110. A slide slot 111 is defined around the first opening 110 of the body 1 and points toward the first opening 110. The outer case 11 further has an engaging slot 112. An inner case 12 is a polygonal case and is disposed in the outer case 11. The inner case 12 has a second opening 120 and an inclined sidewall 121. The inclined sidewall 121 of the inner case 12 is arranged to face to the finger nails, especially to the thumb nail, in a direction perpendicular to the inclined sidewall 121. A base 13 has multiple pads 131 connected thereto, and the outer case 11 and the inner case 12 are mounted to the base 13.

The magnetic slide cover unit 2 has a top part 21 with a ridge 211 which is engaged with the engaging slot 112 of the outer case 11. The top part 21 has a reception slot 210. The magnetic slide cover unit 2 further has a slide cover 22 which has a third opening 220. The slide cover 22 has a boss 221 which is a cylindrical member and engaged with the slide slot 111 of the outer case 11. The boss 221 is connected to a fixing member 222 which positions the boss 221, so that the boss 221 is not disengaged from the slide slot 111. The slide cover 22 is slidably movable toward the first opening 110 of the outer case 11 by moving the boss 221 along the slide slot 111. The slide cover 22 has a first magnetic member 223 and the outer case 11 has two second magnetic member 224 which respectively are located at both ends of the outer case 11 parallel to the slide slot 111 and corresponding to the first magnetic member 223. The first magnetic member 223 contacts the reception slot 210 of the top part 21 when the slide cover 22 moves to a top end of the slide slot 111. The first magnetic member 223 is a magnetic metal and the second magnetic member 224 is a magnet which can attract the first magnetic member 223. The third opening 220 of the slide cover 22 is located corresponding to the first opening 110 of the outer case 11 and the second opening 120 of the inner case 12.

The control unit 3 is connected to the body 1 and has a receptacle 30, a circuit board 32 and a control member 31 connected to the circuit board 32. The control member 31 is a button and is exposed out from the outer case 11.

The light solidifying unit 4 is disposed in the body 1 and has a light emitting diode module 41. The light emitting diode module 41 includes a heat dissipating member 42 and a light emitting diode (LED) 40 located in opposite to the heat dissipating member 42 and connected to the wall of the inner case 12, so that the LED 40 irradiates an interior of the inner case 12. The light solidifying unit 4, the receptacle 30 of the control unit 3 and the circuit board 32 are electrically connected.

Figure 4:
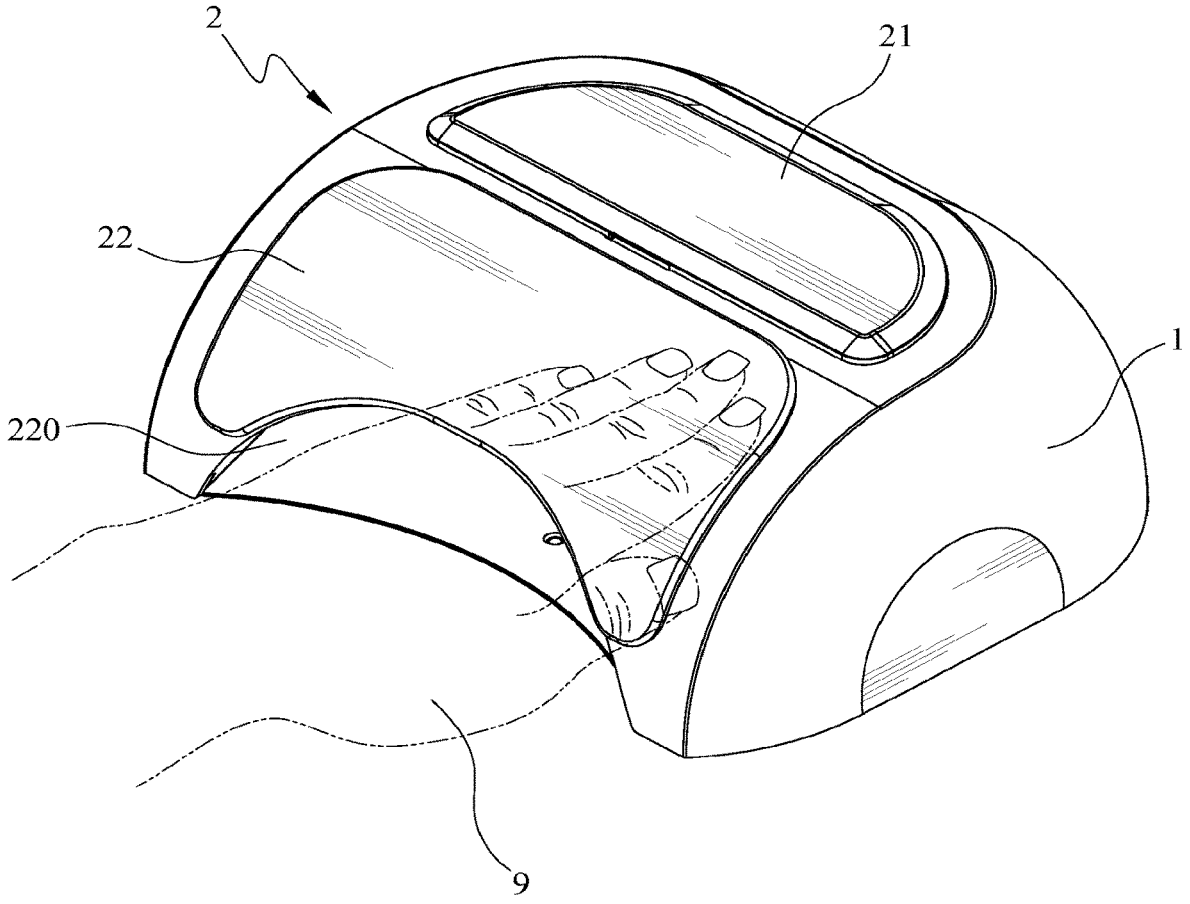
FIG. 4 shows a use state of the light solidifying device of the present invention.

As shown in FIG. 4, when in use, a user's hand 9 with liquid gel coated on the nails is inserted into the device via the first and second openings 110, 120 and put on the base 13. The slide cover 22 is then moved downward and masked the first and second openings 110, 120. The third opening 220 of the slide cover 22 is kept opened for the insertion of the user's hand 9. Therefore, the gap between the hand 9 and the third opening 220 is small enough to stop the light rays from escaping out from the device to stimulate the user's eyes and skin. The position of the slide cover 22 can be adjusted according to practical needs. When the slide cover 22 is adjusted to the topmost or the lowermost position, the first magnetic member 223 is attracted by the second magnetic member 224 to position the slide cover 22. The magnetic force is suitable to let the user easily move the slide cover 22, while the slide cover 22 can be positioned at a predetermined place if no external force is applied thereto.

Then, the user can start to operate the control member 31 of the control unit 3 to activate the light emitting diode 40 to proceed with the solidification and sterilization process. The light solidifying device of the present invention has advantages of no solvent vaporization during the solidification cross-linking process, a shorter required solidification time, no ripple or deformed gel formed on the nails, and good solidification performance.

Because the inner case 12 is a polygonal case and the inclined sidewall 121 of the inner case 21 is arranged to face to the finger nails, especially to the thumb nail, in a direction perpendicular to the inclined sidewall 121, each of the finger nails can be fully irradiated by the UV light rays.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A method of curing a UV-curable nail gel applied to a fingernail or toenail, comprising: applying a layer of UV-curable nail gel onto at least one fingernail or at least one toe nail;

inserting said at least one fingernail or at least one toe nail into a UV-curable device comprising:

a body comprising an outer case having a first opening and a top portion, a slide slot defined around and pointing toward the first opening of the outer case, said slide slot located in the top portion of the outercase, an inner case being a polygonal case and disposed in the outer case, the inner case having a second opening and an inclined sidewall, the outer case and the inner case connected to a base;

a magnetic slide cover unit having a slide cover having a third opening, the slide cover having a boss which is engaged with the slide slot of the outer case, the boss being connected to a fixing member, the slide cover slidably movable toward the first opening of the outer case by moving the boss along the slide slot; the slide cover having a first magnetic member; and the outer case's top portion having a second magnetic member which is located corresponding to the first magnetic member, the third opening of the slide cover located corresponding to the first opening of the outer case and the second opening of the inner case;

a control unit connected to the body and having a receptacle, a circuit board and a control member connected to the circuit board, the control member of the control unit being exposed out from the outer case; and a light solidifying unit disposed in the body and having a light emitting diode module, the light emitting diode module having a heat dissipating member and a light emitting diode (LED) located in opposite to the heat dissipating member and connected to the wall of the inner case, the light solidifying unit and the receptacle of the control unit and the circuit board being electrically connected;

activating said light emitting diode; and irradiating said at least one fingernail or at least one toe nail.

2. A method of curing according to claim 1, further comprising lowering the magnetic slide cover unit prior to irradiating the said at least one fingernail or at least one toe nail.

3. A method of curing according to claim 1, wherein the a magnetic slide cover unit has a slide cover having a third opening and an underside, and wherein the slide cover has a first magnetic member attached to the slide cover's underside.

4. A method of curing according to claim 3, wherein the outer case has an engaging slot and the magnetic slide cover unit has a top part having a ridge which is engaged with the engaging slot, the top part has a reception slot, the first magnetic member contacts the reception slot of the top part when the slide cover moves to a top end of the slide slot.

5. A method of curing according to claim 1, wherein the outer case has an engaging slot and the magnetic slide cover unit has a top part having a ridge which is engaged with the engaging slot, the top part has a reception slot, the first magnetic member contacts the reception slot of the top part when the slide cover moves to a top end of the slide slot.

6. A method of curing according to claim 1, wherein irradiating said at least one fingernail or at least one toe nail comprises solidifying and sterilizing the UV-curable nail gel.

7. A method of curing according to claim 6, wherein solidifying the UV-curable nail gel comprises cross-linking the UV-curable nail gel.

8. A method of curing according to claim 1, wherein applying the layer of UV-curable nail gel onto at least one fingernail or at least one toe nail comprises applying the layer of UV-curable nail gel onto five fingers on the same hand or five toes on the same foot, and wherein inserting said at least one fingernail or at least one toe nail into a UV-curable device comprises inserting the five fingers on the same hand or five toes on the same foot into the second opening.

9. A method of curing according to claim 8, wherein irradiating said at least one fingernail or at least one toe nail comprises simultaneously irradiating the five fingers on the same hand or five toes on the same foot.

* * * * *